United States Patent [19]

Fitch et al.

[11] Patent Number: 4,778,493

[45] Date of Patent: Oct. 18, 1988

[54] ELECTROSTATIC PRECIPITATOR WITH MEANS FOR THE ENHANCED CHARGING AND COLLECTION OF FINE PARTICLES

[75] Inventors: Richard A. Fitch, La Jolla; James E. Drummond, Oceanside, both of Calif.

[73] Assignee: Maxwell Laboratories, Inc., San Diego, Calif.

[21] Appl. No.: 856,490

[22] Filed: Apr. 28, 1986

[51] Int. Cl.[4] ..... B03C 3/38

[52] U.S. Cl. ..... 55/136; 55/135; 55/145; 55/151

[58] Field of Search ..... 55/136–138, 55/135, 151, 143, 145

[56] References Cited

U.S. PATENT DOCUMENTS

| | | | |
|---|---|---|---|
| 1,200,887 | 10/1916 | Schmidt | 55/151 X |
| 1,335,758 | 4/1920 | Schmidt | 55/136 X |
| 1,343,285 | 6/1920 | Schmidt | 55/2 |
| 1,357,466 | 11/1920 | Moller | 55/138 X |
| 1,766,422 | 6/1930 | Wintermute et al. | 55/136 X |
| 2,061,045 | 11/1936 | Ruder et al. | 55/136 |
| 2,255,677 | 9/1941 | Penney | 55/138 X |
| 2,537,558 | 1/1951 | Tigges | 55/135 X |
| 2,554,247 | 5/1951 | Hedberg | 55/135 X |
| 3,149,936 | 9/1964 | Rich | 55/138 X |
| 3,250,060 | 5/1966 | Van Luik, Jr. et al. | 55/138 X |
| 3,365,858 | 1/1968 | Penney | 55/138 X |
| 4,209,306 | 6/1980 | Feldman et al. | 55/151 X |

FOREIGN PATENT DOCUMENTS

| | | | |
|---|---|---|---|
| 496812 | 2/1978 | Australia | 55/138 |
| 629665 | 10/1961 | Canada | 55/138 |
| 212811 | 3/1924 | United Kingdom | 55/135 |

*Primary Examiner*—Kathleen J. Prunner

*Attorney, Agent, or Firm*—Fitch, Even, Tabin & Flannery

[57] ABSTRACT

An electrical precipitator which uses a combination of field charging, diffusion charging, and electron charging for the enhancement of fine particle charging and collection. A precipitator is described for the collection of fine particles of less than 1.0 micron in diameter from an effluent by enhancing the charge thereon by electrons of high kinetic energy. Another feature of the invention describes a precharging stage which can be added to the electron charging stage, or other conventional precipitator stage, that operates the basis of ion bombardment or diffusion of thermally active ions. The precharging stage charges the fine particles and they can later be increased in charge and precipitated by the electron charging stage. Another feature of the invention describes disposing a conventional stage for coarse particulates over 1.0 micron in diameter between the diffusion charging stage and the electron charging stage.

25 Claims, 3 Drawing Sheets

ELECTROSTATIC PRECIPITATOR WITH MEANS FOR THE ENHANCED CHARGING AND COLLECTION OF FINE PARTICLES

The invention pertains generally to electrostatic precipitators and is more particularly directed to such precipitators with means to enhance the charging of fine particles so that they may be collected more efficiently.

The process of electrical precipitation depends upon the magnitude of the force acting on a charged particle in an electric field. For a given particle size, the greater the force on the particle, the greater the probability that the particle can be collected. The force on the particle is directly proportional to two operating parameters of the precipitator, the electrical field across the plates, and the charge on the particles. The higher the charge on the particle and the higher the field, the greater the force. Therefore, efficient precipitators will attempt to maximize the particle charge and the field to allow smaller and less expensive precipitators to be built for a predetermined collection efficiency.

In most precipitators today, the principal mechanism of particle charging is that due to ions driven onto the particles by an electrical field between the collection plates. The ions are formed from electrons generated by corona discharge from a wire or other emission surface between the plates which charge molecules of an effluent gas. Known as "field charging" this conventional charging method is more fully described in H. J. White, *Industrial Electrostatic Precipitation,* Addison-Wesley Publishing Company, Inc., 1963.

While the dominant charging mechanism is field charging in modern electrical precipitators, there are other contributions to particle charging by such mechanism as "diffusion charging" and "electron charging".

Diffusion charging occurs by the bombardment of the particles by high energy ions at the extreme end of their thermal distribution. The ions produced by the corona discharge are distributed according to kinetic energy over a range with most substantially at an average thermal energy and very few at higher energies. The diffusion charging process is usually negligible for particles over 1.0 micron in diameter but is the dominant process for particles less than 0.2 micron in diameter. Generally, the diffusion charging is not done as efficiently as possible. In conventional precipitators, the particles spend too little time in a stage to accumulate all the diffusion charges available since it is a slower process than field charging.

Although it has long been recognized that some particle charging can be attributed to electrons, for example see G. W. Penney and R. D. Lynch, "Measurements of Charge Imparted to Fine Particles by a Corona Discharge," pp. 294–299, July 1957 and J. R. McDonald et al., "Charge Measurements on Individual Particles Exiting Laboratory Precipitators with Positive and Negative Corona at Various Temperatures, *Journal of Applied Physics,* 51(7), pp. 3632–3643, July 1980, their contribution to charging has been considered small. Under the conditions typical in existing precipitators, a high electron attachment coefficient means that few electrons will survive outside a small volume near the cathode. Because the particulate flow in that volume is very small compared to the total volume flow the probability of particles attaining substantial charge from the electrons is very low.

Increasingly, governmental agencies, such as the Environmental Protection Agency, have become concerned about air pollution of submicron particles. These submicron particles from carbonaceous combustible fuels, or other sources, stay in the atmosphere the longest and can create the most damage to humans when they get into the lungs. A recent EPA proposal suggests replacing the current U.S. standards which relate to total suspended particulate matter with a new standard addressing particles of less than 10 microns. Submicron particles are notoriously the most difficult to precipitate in electrical precipitators. Mainly this is because the net force on a particle is proportional to the radius of the particle. While the viscous or retarding force increases with radius the amount of charge or accelerating force can increase by the radius squared or the area. Thus, small particles do not have enough force exerted on them to be efficiently precipitated.

A precipitator that is capable of boosting the charge on fine particles, e.g., less than 1.0 micron, would be very advantageous because it would increase the probability of collection of these particles which have heretofore been inefficiently collected in electrical precipitators. The collection efficiency gain will be in proportion with the additional amount of charge which can be deposited on the particles in excess of their field charging.

SUMMARY OF THE INVENTION

The invention comprises an electrical precipitator with means to efficiently use a combination of field charging, diffusion charging, and electron charging for the enhancement of fine particle charging.

The diffusion charging and electron charging are used to increase the charge on fine particulate matter, under 1.0 micron in diameter, so that this size of dust loading can be efficiently collected by electrostatic precipitation. The field charging is used to efficiently precipitate coarse particulate matter, in excess of 1.0 micron in diameter, to remove such from interfering with the collections of the fine particulate matter.

In the preferred implementation, a diffusion charging stage charges fine particulate matter suspended in the effluent to a high electrostatic charge primarily by diffusion charging. The effluent is then passed through a field charging stage where coarse particulate matter is charged primarily by field charging and precipitated with the field used to charge the coarse matter. The effluent is thereafter passed through an electron charging stage which increases the charge on the fine particulate matter to a greater value primarily by electron charging to where it can be precipitated by a collection field generated in that stage.

This combination optimizes the collection process such that there will be a high probability that both the coarse and fine particulate matter will be collected. The coarse material is collected prior to the collection of the fine material so that the last stage can be tailored for the final precipitation process. The precharging of the fine material increases the chance that it will be collected and occurs at a time when the flue gas is most thermally active.

Each stage is optimized for its particular function. The diffusion charging stage is arranged to generate significant numbers of thermally active ions which are long lived in the first stage. This operation efficiently precharges the fine particulate matter. The field charging stage is arranged to efficiently field charge and collect the coarse particulate matter by generating large quantities of ions and an intense DC collection field. The electron charging stage is arranged to generate significant numbers of electrons which have a high kinetic energy and an intense DC collection field. The electron charging stage is further arranged to enhance the probability of an electron striking of a fine particle prior to attachment to a gas molecule. This efficiently increases the charge on the fine particles and the probability of their being collected.

This configuration takes advantage of a dedicated stage which uses diffusion charging as a primary charging mechanism. The particles are allowed to stay in the stage long enough to obtain significant diffusion charge and the stage is preferably configured with a pulsed power supply. A pulsed power supply produces intense bursts of corona such that many highly active ions are generated in the stage. The time average field is maintained at a minimum with the pulsed supply such that the ions will have a long lifetime. Preferably, the diffusion charging is accomplished prior to a preheater which would cool the highly active ions.

This configuration further is advantageous because of a dedicated stage which uses electron charging as a primary charging mechanism. A pulsed power supply produces intense bursts of corona such that many electrons with a high kinetic energy are generated in the stage. Because the coarser particles which are easier to precipitate have been removed from the effluent, the electron charging stage can be arranged to optimize the exposure of the particulate matter to the electrons and thereby increase their charge over that of field charging.

The invention features other independent combinations of the diffusion charging stage, field charging stage, and electron charging stage. If conditions exist such that only light dust loading of a fine particulate nature exists, then the electron charging stage may be used independently as a precipitator without a separate field charging stage. This operation can be alone or in combination with a diffusion charging stage as a precharger.

The field charging stage and the electron charging stage can be used in combination without the diffusion charging stage. The diffusion charging stage is an enhancement to the combination but not a necessity. Finally, it is contemplated by the invention that the diffusion charging stage can be used as a precharging stage for a conventional field charging stage.

These and other objects, features, and aspects of the invention will become apparent upon reading the following detailed description when taken in conjunction with the attached drawings wherein:

DETAILED DESCRIPTION OF THE PREFERRED EMBODIMENT

The invention contemplates using electrons and/or ions with high kinetic energy levels to increase the charge which can be placed on fine particulate matter in an electrostatic precipitator. Increasing the charge on a particle over that which can commonly be induced by field charging will markedly increase the chances of a particle being collected by the amount of the charge increase.

In a wire-plate precipitator, the cathode wire has impressed thereon a high negative voltage and the plate is grounded. This creates an intense DC field between the cathode and the anode which based upon the voltage causes corona discharge from the wire electrode in the form of electrons. Depending upon the parameters of the system, particularly the attachment coefficient, the electrons attach themselves to molecules in the gas flowing therethrough to become ions. The ions drift in the field and are driven onto dust particles entrained in the gas which accept the charge thereof by action of the field. The charged particles can then be collected by the force exerted on them by a DC collection field. There is a charge level proportional to the collection field beyond which this field charging will not add any charge to a particle. It is the intent of the invention to increase the charge beyond this saturation charge by bombardment of the entrained particles with high energy electrons before they become attached as ions and/or by bombardment with high energ ions in the tail end of the in thermal distribution.

Figure 8:
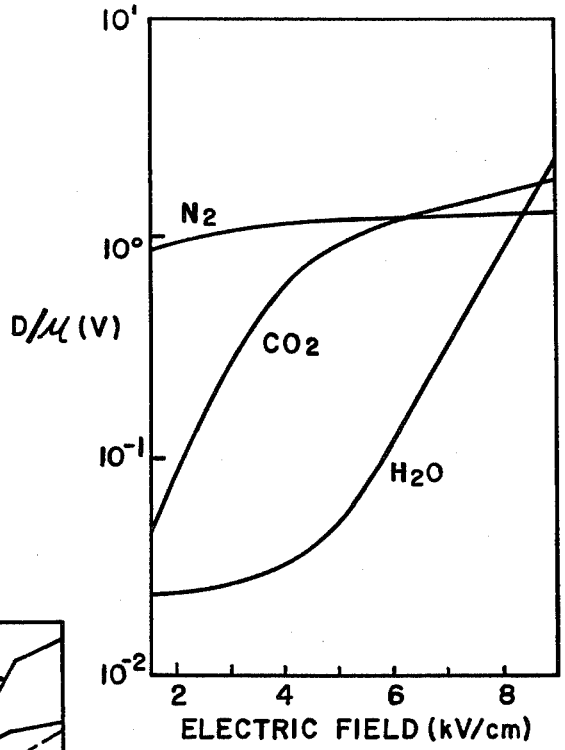
FIG. 8 is a pictorial representation of the diffusivity/-mobility curves for the principal flue gas components which flow through a precipitator such as that illustrated in FIG. 1.

For electron charging to be effective, both electron kinetic energy and electron number density must be significant. At the fields typical of conventional precipitators, 2–4 kV/cm the electron diffusivity/mobility ratio, $D/\mu$, is so low that the electrons transfer little of the energy they acquire from the field to their own transverse motion. At fields above about 5 kV/cm, however, the $D/\mu$ ratio begins to increase rapidly for $H_2O$ (see FIG. 8) and significantly for $CO_2$. For $N_2$ it is relatively high throughout, i.e., it never affords a significant energy sink for the electrons. This means that at a field between 5 and 8 kV/cm transverse scattering increases rapidly and the electrons gain an order of magnitude more kinetic energy. They are thus able to bombard the particles and build up a charge beyond the field-charging limit.

The process is rather like diffusion charging by ions, the difference is that the electrons are at a very much higher kinetic energy. Unlike ions, which transfer energy to gas molecules readily because of their matching mass, electrons transfer the energy that they gain from the field slowly to the gas but rapidly to their own random motion because of their high $D/\mu$ ratio. Thus, while ions remain essentially at the flue gas temperature, the electrons are much more energetic thermally. Thus, despite their much lower number density (they move faster than the ions, and their numbers are rapidly depleted by attachment), they can still make a useful contribution to particle charging, the process termed "electron charging".

To determine the increase in charge available from electron charging, the theoretical maximum kinetic energy of an electron for a given field will be calculated. This energy will then be compared with the potential energy of an electron on a dust particle to determine the barrier energy (saturation level) which a free electron must overcome before it can charge the particle further. The difference between the potential energy and the kinetic energy is then available for increased charging.

Strictly speaking, there is no maximum saturation level with electron or diffusion-type charging since some electrons (or ions) will exist sometime at indefinitely high energies. But, in practice, not only is residence time of particles limited in the precipitator (generally to less than 10 seconds), but the electrons have a Druyvesteyn velocity distribution for a given field which has a near cut-off at higher velocities and can be well approximated by an average energy. It is instructive, therefore, to compare the kinetic energy of the average electron with the potential energy of an electron at the particle surface. Theoretical "saturation" charging occurs when the potential energy is equal to or greater than the kinetic energy available to charge a particle.

An approximate formula based on Blanc's Law with data extrapolated from Huxley and Crompton, *The Diffusion and Drift of Electrons in Gases,* John Wiley and Sons, 1974, gives an approximate expression for the average kinetic energy of the bombarding electrons.

$$K \simeq 1.3 \frac{X_1/\mu_1 + X_2/\mu_2 + X_3/\mu_3}{X_1/D_1 + X_2/D_2 + X_3/D_3} \quad (1)$$

where $\mu$ and D are the mobility and diffusivity respectively, the factor 1.3 is the ratio between the average and the characteristic energies for a Druyvesteyn velocity distribution, and $X_n$ is the mole fraction for the various gases—here taken to be $X_1=0.77$ $N_2$, $X_2=0.19$ $CO_2$, $X_3 0.04$ $H_2O$ for the dry case, and 0.56 $N_2$, 0.14 $CO_2$ and 0.30 $H_2O$ for the wet case. Note that the kinetic energy is dominated by the value of D since $\mu$ remains nearly constant—thus it is the low values of $D/\mu$ which control the denominator in Equation (1).

The potential energy P of an electron at the particle surface can be derived from Coulomb's Law on the assumptions that there are no other charges in the vicinity and that the charge on the particle is uniformly distributed over its surface. These assumptions are reasonable, since $\epsilon p$ is typically very small compared with the particle residence time.

$$P = \frac{n_e e^2}{4\pi\epsilon_o a} \quad (2)$$

where e is the electronic charge, $\epsilon_o$ is the permittivity of the gas, a is the radius of the particle, and $n_e$ is the number of electron charges on the particle.

Field charging gives the saturation value of ($n_e e = Q$) as:

$$Q_s = 12\pi\epsilon_o a^2 E \quad (3)$$

whence, $$P = 3aEe \quad (4)$$

where E is the ambient electric field due to the voltage between the precipitator electrodes. The dielectric constant has been dropped from Equation (2) because the particles are not perfect insulators and the dielectric effect vanishes after a few relaxation time constants ($T = k\rho/4\pi$)—the particle has become in effect a perfect conductor, equivalent to $k = \infty$. Equation (4) gives the potential energy relative to a remote point on the equatorial plane of the particle; for all other points the potential energy is affected by the ambient field.

Figure 9:
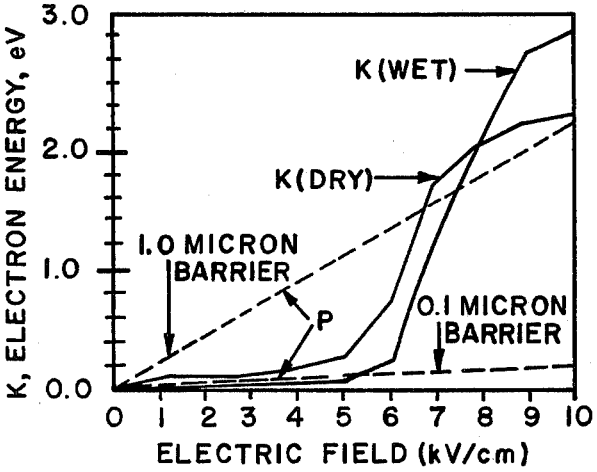
FIG. 9 is a graphical representation of the barrier energy of saturation for charged particles of different sizes and the average kinetic energy of electrons as a function of the field strength of a precipitator such as that illustrated in FIG. 1.

Equations (1) and (4) are shown plotted in FIG. 9 as a function of the electric field. FIG. 9 shows the (equatorial-plane) potential energy for both the 1.0 micron and 0.1 micron particles; these lines represent barriers for energies below which the electrons cannot land on and further charge a dust particle. However, these barriers are applicable only to the equator; in the hemisphere facing the discharge electrode the barrier is effectively reduced by the ambient field so that the electron cloud is able to charge the particle beyond the level represented by the kinetic-energy curves; while in the other hemisphere the ambient field effectively raises the barrier. An approximation that the two effects cancel out can be made.

It can be seen that the electron charging is significant for 1.0 micron particles above a field of about 6 kV/cm, and becomes pronounced by about 8 kV/cm; while at 10 kV/cm the theoretical improvement is a factor of 15. For fine particulate matter less than 1.0 micron the improvement factor over field charging is even greater.

To determine if this amount of charge can effectively be placed on a particle, it is necessary to examine the maximum charge that a particle can sustain without developing a self-corona discharge. To determine the charge limit, we equate the maximum field strength at the particle surface to the corona inception field. The field at the surface of the particle is a maximum at the pole facing the collector electrode—where it is the sum of the vacuum field, space-charge field, and the field due to the charge and the polarization of the particle itself. The self field is exactly equal to the sum of the vacuum and space-charge fields when the particle reaches saturation charge. Therefore, for the maximum field at the particle surface at a point R, we can write:

$$E_s\max = 3\,[E(R,V) - E_{sc}] + \frac{Q}{a^2} \tag{5}$$

where R is the radial distance of the point from the center of the pipe, V is the voltage on the wire, $E_{sc}$ the space-charge field, Q is the charge on the particle, and a is the particle radius. Rewriting Equation (5) as:

$$E_s\max = 3E_o\left(1 + \frac{Q}{Q_s}\right) \tag{6}$$

where $E_o$ is the field at the particle when Q=0, and $Q_s$ is the (field) saturation charge.

The corona inception voltage has been studied by F. W. Peek, Jr., *Dielectric Phenomena in High Voltage Engineering,* 3rd ed., New York: McGraw-Hill, 1929, who produced the following formula:

$$E_c = 30\delta f\left(1 + 0.3\sqrt{\frac{\delta}{R_w}}\right)\text{kV/cm} \tag{7}$$

where δ is the gas density ratio relative to NTP, f is a roughness factor, and $R_w$ is the radius of the wire in centimeters. Adapting for the case of a spherical particle (in place of a wire), it is suggested:

$$E_c = 30\delta f\left(1 + 0.3\sqrt{\frac{\delta\log(R_p/R_w)}{a}}\right) \tag{8}$$

where $R_p$ is the radius of the pipe. It should be pointed out that Peek developed the formula for typical pecipitator situations where the write radius is of the order of 1 mm. Thus, the equation may not extrapolate linearly to dimensions of the order of 1 micron.

Equating $E_{s\ max}$ from Equation (5) with $E_c$ from Equation (8), where Q becomes $Q_c$ (the corona inception charge), we get:

$$\frac{Q_c}{Q_s} = \frac{10\delta f}{E_o}\left(1 + 0.3\sqrt{\frac{\delta\log(R_p/R_w)}{a}}\right) - 1 \tag{9}$$

Assuming, for example:

δ=0.65 f=0.6 and $R_p/R_w=80$ we get:

$$\frac{Q_c}{Q_s} = \frac{3.9}{E_o}\left(1 + \sqrt{\frac{0.26}{a}}\right) - 1 \tag{10}$$

or, since 1<< the expression in the square root for submicron particles, we can derive an approximate expression for the limiting value of elecron charge enhancement:

$$\frac{Q_c}{Q_s} = \frac{2}{E_o a^{\frac{1}{2}}} \tag{11}$$

If a worst case scenario is assumed such that the maximum electric field is 30 kV/cm, we see that the minimum permissible charge enhancement is approximately 66 times for a 1.0 micron particle and 200 times for a 0.1 micron particle. Thus, particles can accept all of the kinertic energy available from electron charing without self corona.

Further, to determine if electron charging will be effective it must be determined if the increased charge cna be placed on the fine particles within a resonable time limit. The electron charging rate dQ/dt depends upon the number density of electrons, the projected ara of the particle, and the velocity distribution of the electrons in its immediate vicinity—which in turn depends upon the electric field. Thus, we can write:

$$\frac{dQ}{dt} = -e\pi a^2 \int_o^\infty f(a,v)v^3dv \tag{12}$$

where f (r,v) is the distribution function of the electron speeds at a distance r from the center of the particle averaged voer 4π steradians, and e is the magnitude of the electronic charge. The frequency of inelastic collisions is low compared with the inverse transit time of an electron across a distance of several microns, and so we may assume conservation of electron energy in the approach of an electron to the particle. Thus, each group of particles with a given total energy, $W=\frac{1}{2}mv^2$, can be represented byits own distribution functions satisfying the mobility/diffusion equation:

$$f_W(r)v_{rd} = \mu f_W(r)\frac{\partial\phi}{\partial r} - D\frac{\partial f_W(r)}{\partial r} \tag{13}$$

where $$\frac{\partial f_W(r)}{\partial r}$$

is taken holding the energy group, W, fixed, $V_{rd}$ is the component of electron drift velocity directed outward from the particle center, and ϕ is the potential due to the charge on the particle.

Since $$\mu = e/m\nu \tag{14}$$

and $$D = V^2/3\nu \tag{15}$$

where m is the electron mass and ν is the momentum transfer collision frequency.

Rewriting Equation (6):

$$f_W(r)\,v_{rd} = \frac{1}{\nu}\left(\frac{e}{m}f_W(r)\frac{\partial\phi}{\partial r} - \frac{v^2}{3}\frac{\partial f_W(r)}{\partial r}\right) \tag{16}$$

As a conservative approximation in calculating $f_W(a,v)$ let $v_{rd}=0$ for r>a; then:

$$\frac{e}{m}f_W(r)\frac{\partial\phi}{\partial r} = \frac{\partial v^2}{3}\frac{\partial f_W(r)}{\partial r} \tag{17}$$

This can be written in terms of $v_\infty$ (the rms value of v, averaged over $\theta$, many radii from the particle) and r, since $v_\infty$ is determined by these variables. Calling $f_W(r)$ re-expressed in this way $F(r,v_\infty)$, there can be written:

$$\frac{e}{m} F(r,v_\infty) \frac{\partial \phi}{\partial r} = \frac{v_\infty^2 + 2e\phi/m}{3} \frac{F(r,v_\infty)}{\partial r} \quad (18)$$

which can be integrated to give F(r,v):

$$F(r,v_\infty)=(1+2e\phi/mv_\infty^2)3/2\ F(r_\infty,v_\infty) \quad (19)$$

Writing Equation (12) in terms of $F_W(r)$, we get:

$$f_W(r) = \left(1 - \frac{Qe}{2\pi m v^2 \epsilon_o r}\right)^{-3/2} F(r_\infty, \sqrt{v^2 - Qe/2\pi\epsilon_o mr}) \quad (20)$$

where the asymptotic distribution function has the Druyvesteyn form:

$$F(r_\infty,v_\infty)=0.26\ N(R)[\exp-(V_\infty/\beta)^4]/\beta 3 \quad (21)$$

which is the speed distribution of electrons at a distance R from the wire, and at many particle radii from the center of the particle, averaged over $4\pi$ steradians; R is the radial distance from the wire center in a wire/pipe precipitator (radial geometry has been chosen for simplicity; the results are similar qualitatively for wire/-plate geometry), the parameter $\beta$ is related to the kinetic energy, K[E(r)], shown in FIG. 9:

$$\beta^2=2.7\ K[E(r)]/m \quad (22)$$

The speed distribution is combined with an electron density, $n_e(R)$, resulting from emission from the wire and attachment in the gas. It will be governed by an equation like Equation (13) where the flux is determined by the electron emission at the cathode:

$$I\ exp\ [\alpha(R_c - R)]/2\pi Re = -\mu E n_e(R) - D\frac{\partial n(R)}{\partial R} \quad (23)$$

where $\alpha$ is the attachment coefficient for electrons. Here both $\alpha$ and D depend upon the electric field, E(R). Near the wire, the last term of the right side of Equation (23) is very much smaller than the first term. Consequently, $$n_e(R)=I\ \exp\ [\alpha(R_c-R)]\ \log\ (R_p/R_W)/2\pi eV\mu \quad (24)$$

using this expression in Equation (5) gives $$\frac{dQ}{dt} = -\frac{0.82\ ea^2 n_e(R)}{\beta^6} \int_o^\infty \frac{v^6 \cdot dv}{e^{x2} \cdot x^{3/2}} \quad (25)$$

with $x=(v^2-eQ/2\pi M\epsilon_o a)/\beta^2$. Setting Q=0 in Equation (18) gives the initial charging rate:

$$\left(\frac{dQ}{dt}\right)i = -0.2\ ea^2\beta n_e(R) \quad (26)$$

Figure 10:
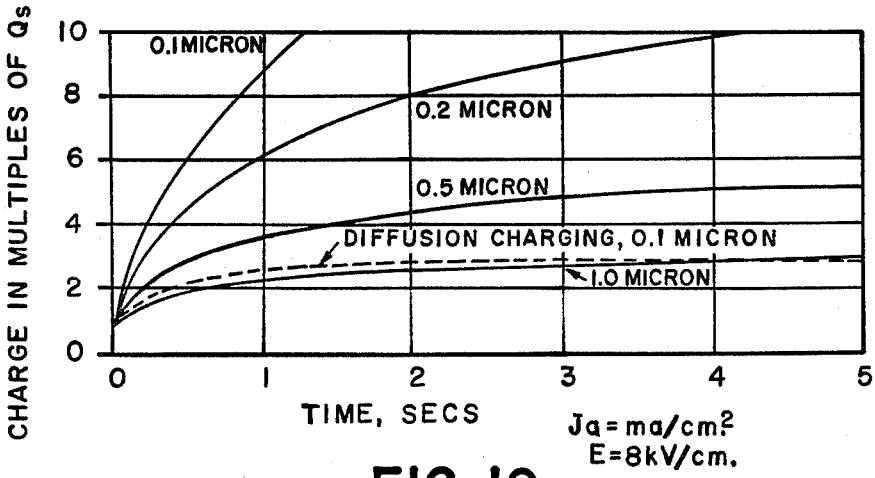
FIG. 10 is a graphical representation of the theoretical quantity of charge, as a function of time, that can be placed on particles of different diameters at a given field strength by electron charging.

Equation (25) is plotted in FIG. 10, with particle diameter as parameter. Electron charging is a slower process than the initial field charging, and so the curves start from a value of 0.9 $Q_s$ on the assumption that field charging rapidly raises the charge to 90 percent of the field saturation value. FIG. 10 has been plotted using two simple numerical integrations. First, the integral in Equation (25) was evaluated using Simpson's Rule with 21 points between $x=x_{min}(Q)$ and x=4. The remainder, between x=4 and $x=\infty$, is quite negligible so that the accuracy is within 0.1 percent. These results were evaluated at up to 93 values of Q in a second Simpson's Rule integration to get $Q/Q_s$ versus t, and these results are accurate to about 1 percent.

The curves of FIG. 10 have been calculated to show the electron charging rates, for a flue gas at 300° F. from a typical coal-fired boiler, at a distance of 1 cm from an electron source in radial geometry. The ion diffusion-charging curve for 0.1 micron particles is also shown for comparison. We have assumed an E field of 8 kV/cm, and the abscissa can be read as residence time in seconds for a current density Ja of 5 $\mu$A/cm, or 64 nA/cm$^2$ at the collector in a 25 cm diameter pipe. Therefore, it has been shown that electron charging can be used effectively to enhance field charging because it can be accomplished in a reasonable amount of time.

Figure 1:
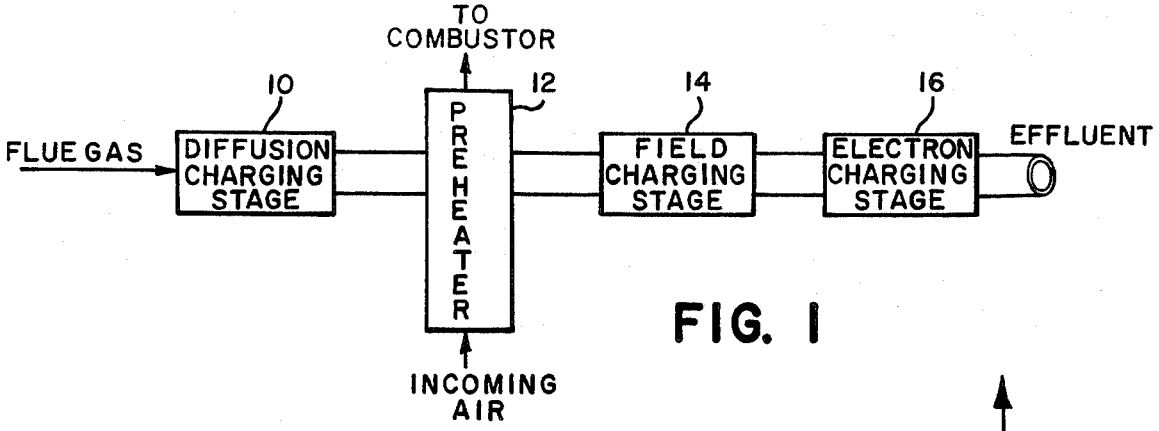
FIG. 1 is a system block diagram of an electrostatic precipitator constructed in accordance with the invention.

There will now be described a novel precipitator using the above described teachings to advantage. In FIG. 1 there is illustrated an electrostatic precipitator constructed in accordance with the invention. The electrostatic precipitator is a multistage system including a diffusion charging stage 10, a field charging stage 14, and an electron charging stage 16. Flue gas from the combustion of carbonaceous material such as coal, oil, or natural gas is passed through the diffusion charging stage 10, through a preheater 12 onto the field-charging stage 14, and then to the electron charging stage 16 before becoming effluent which is emitted to the atmosphere. The preheater uses the heat content of the flue gas to preheat incoming air for the combustor to increase overall efficiency.

In general, the diffusion charging stage is used to place an electrostatic charge on fine particulates suspended in the effluent primarily by the mechanism of diffusion charging. By fine particles the term is used to designate that particulate matter which is less than 1.0 micron in diameter. The diffusion charging stage 10 charges the fine particles by diffusion charging whereby high energy ions in the tail of the thermal ion distribution are used for this purpose. The diffusion charging stage 10 is arranged such that the mechanism of diffusion charging is enhanced. Other particulate matter of a coarse nature, greater than 1.0 micron in diameter, which is also suspended in the effluent will attain some charge but not of appreciable significance.

Such a diffusion charging stage 10 would be advantageous to be placed either before or after the preheater 12, but preferably the stage is placed prior to preheating. The reason is that the preheater 12 transfers some of the thermal energy of the flue gas to the incoming air thereby lowering the overall average temperature of the molecules and ions in the effluent. Because the diffusion charging mechanism operates based upon the thermally active ions in the tail end of the distribution, the placement of the diffusion charging stage after the preheater will reduce their number. Thus, although the diffusion charging stage 10 will work after the preheater, it is preferred that the temperature loss due to this device not be taken until after the initial diffusion mechanism has charged the fine particles. Subsequently, the lowering of temperature through the preheater 13 will not significantly reduce the charge on the fine particles once the diffusion process has taken place. The preheater, however, must be of a construction which does not appreciably reduce the precharging on the particles due to collisions of the particles with its walls. If the preheater is such that more charge is lost because of the mechanical construction of the device than is gained from the increased thermal activity of the ions, then the diffusion charging stage is preferably located downstream of the preheate 12.

Figure 11:
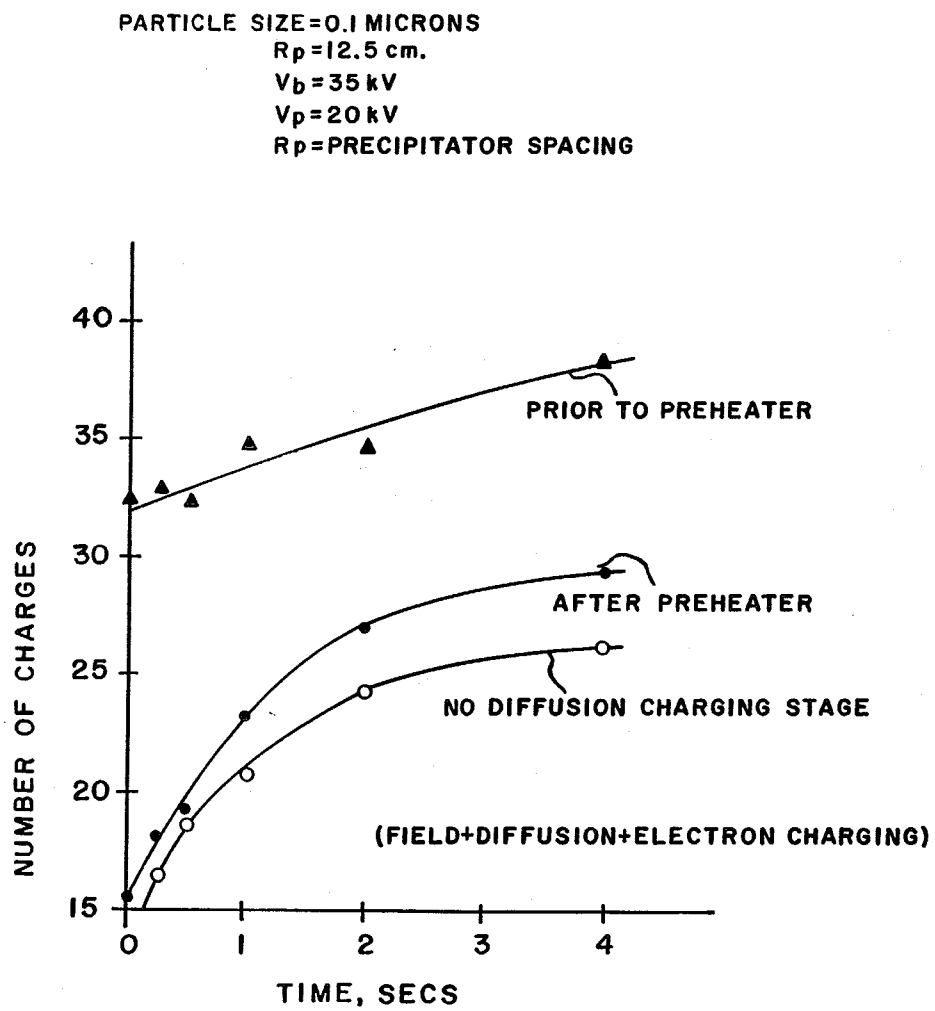
FIG. 11 is a graphical representation of the theoretical number of charges on a particle as a function of the time illustrating the contribution of a diffusion charging stage disposed prior to an air preheater.

FIG. 11 illustrates the significant degree to which a one-second diffus charging stage 10 will increase the charge on 0.1 micron particle. The increase is especially marked because the diffusion charging 10 stage is placed prior to the air preheater 12 and a pulsed power supply is used to provide intense bursts of corona discharge. The increase is over 100 percent initially, but tapers off somewhat as the particle proceeds through the precipitator and ordinary diffusion charging begins to catch up. However, particle charging is most effective when it occurs early.

In the next stage or field charging stage 14, the coarse particles, e.g., over 1.0 micron in diameter, of the effluent are charged and collected. The field charging stage 14 may be of conventional design with slightly extra wide plate spacing for dusts of moderate resistivity. The function of the field charging stage 14 is to remove the bulk of the coarse dust such that the effluent gas leaving the field charging stage 14 contains less than 10 percent of the original dust load. Thus, the gas leaving the field charging stage 14 will bear mainly small particles of which the very fine, less than 1.0 micron in diameter, will have been highly charged in the diffusion charging stage 10.

The effluent gas with this remaining particulate matter load is then charged further by electron charging in the electron charging stage 16. The fine particulate matter is then precipitated by the electron charging stage 16 before being emitted to the atmosphere. The electron charging stage 16 uses the mechanism of electron charging to significantly increase the precharging of the fine particulate matter of the effluent. Because the coarse material has already been removed by the field charging stage 14, the electron charging stage 16 can be tailored mechanically to efficiently precipitate the very fine particles. The electron charging stage 16 further is arranged to enhance the mechanism of electron charging to thereby increase and optimize the amount of charge which can be placed on the fine particulate matter.

Figure 2:
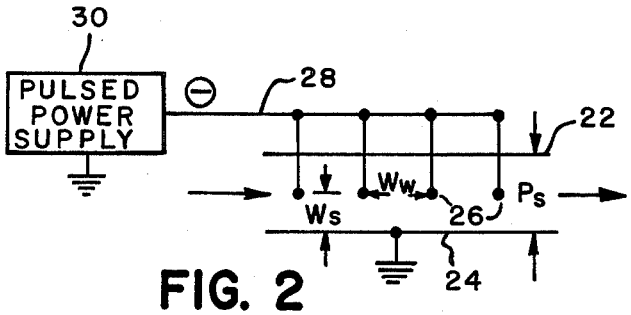
FIG. 2 is a schematic view representative of a section comprising a portion of the diffusion charging stage, field charging stage, and electron charging stage of the precipitator illustrated in FIG. 1.
Figure 3:
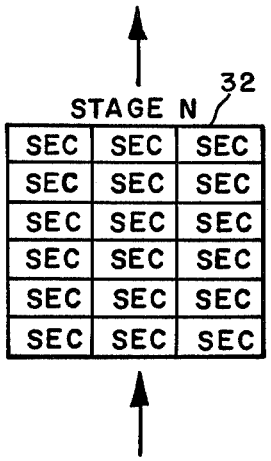
FIG. 3 is a pictorial representation of the segmentation of a stage using the sections illustrated in FIG. 2.

A preferred implementation for the diffusion charging stage 10, field-charging stage 14, and electron charging stage 16 is illustrated in FIGS. 2 and 3. In FIG. 2 there is shown a precipitator section including anode plates 22 and 24. The anode plates 22 and 24, or collector plates, are grounded and form a parallel channel for passing the effluent gas therethrough. The channel is occupied by one or more centrally located and commonly connected wire electrodes 26 acting as a cathode. The one or more wire electrodes 26 are powered from the negative terminal of a pulsed power supply 30. The element shown in FIG. 2 illustrates a wire-plate precipitator or charging section which can be segmented as shown in FIG. 3 to form a portion or group of a precipitator stage. It is shown that 18 sections of the type shown in FIG. 2 have been used to form a three channel, six row precipitator stage. It is readily evident that the number of channels and the length of the channels (number of rows) for each stage will depend upon the physical characteristics and operational needs of the site at which the precipitator is installed. The dimensions will mainly be governed by the volume flow rate of the effluent, and the amount of dust loading, and its resistivity.

A pulsed power supply 30 that powers each section is one which comprises a means for controllably energizing the single electrode wire 26 or small group of electrode wires with periodic high voltage pulses which cause a corona discharge from the wires and means for controllably maintaining a substantially constant DC voltage for a collection field between the high voltage pulses. Such a pulsed power supply is illustrated more fully in U.S. application Ser. No. 597,536 entitled "Multiple Segment Electrostatic Precipitator with Independently Pulsed Charging Means" by Richard A. Fitch, which is commonly assigned with the present invention. The power supply 30 includes means for varying the peak voltage of the pulses, their spacing, repetition rate, and width. Further, means are provided for the pulsed power supply 30 to vary the base or DC voltage used for collection purposes. By controlling these parameters, different electrical characteristics can be obtained from the section illustrated in FIG. 2.

Returning now to FIGS. 1 and 2 for a moment, it is seen that all the charging stages including diffusion charging stage 10, field charging stage 14, and electron charging stage 16 are of similar construction. They are comprised of a wire-plate precipitator or charging sections, each powered by a pulsed power supply 30. The difference between the several charging stages is that different mechanisms of particle charging are primarily used in each of the different stages. The different methods of charging are accomplished by varying the precipitator physical parameters, basically plate spacing $P_S$, wire to plate spacing $W_S$, and wire-to-wire spacing $W_w$ in the precipitator sections, and by varying the electrical parameters of the pulsed power supply 30.

Figure 4:
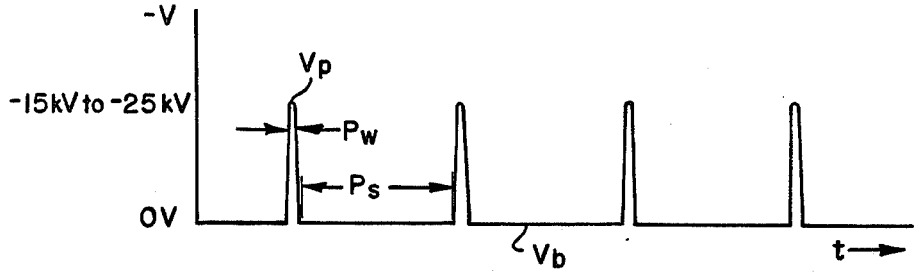
FIG. 4 is an electrical waveform diagram of the output of a pulsed power supply for the diffusion charging stage illustrated in FIG. 1.

For the diffusion charging stage 10, pulsed power is delivered to the stage as illustrated in FIG. 4. The base voltage $V_b$ of the power supply is set at 0 volts DC because the diffusion charging stage 10 is not meant for collecting particles. Collection of the fine particles at this stage would be hindered by the collection of the coarse particles, reentrainment, and other problems. Therefore, the average field, to which the average velocity of the charging ions is proportional, will be made as small as possible. This is to provide relatively long lived ions which will then have the greatest possibility to charge the fine particulate matter of the effluent.

Thus, a pulse spacing $P_s$ and pulse width $P_w$ in an exemplary form might be a pulse width of 20–300 microseconds with and an off time of a few milliseconds, say 2–20. The peak pulse should be just below the sparking limit of the configuration such that intense corona and the greatest number of ions are generated with each pulse. Thus, the peak voltage $V_P$ for pulses of the diffusion charging stage 10 could be as high between −15 kV to −25 kV. Further, as mentioned previously, the flue gas should be charged by the diffusion charging stage 10 while the gas is at its highest possible temperature so that the ions generated will remain thermally active and diffuse throughout the effluent. The wire/-plate arrangement for the diffusion charging stage 10 is generally similar to conventional with a plate spacing $P_S$ of 4 inches, a wire to plate spacing $W_S$ of ½ that width, and a wire-to-wire spacing $W_w$ equal to the plate spacing.

Figure 5:
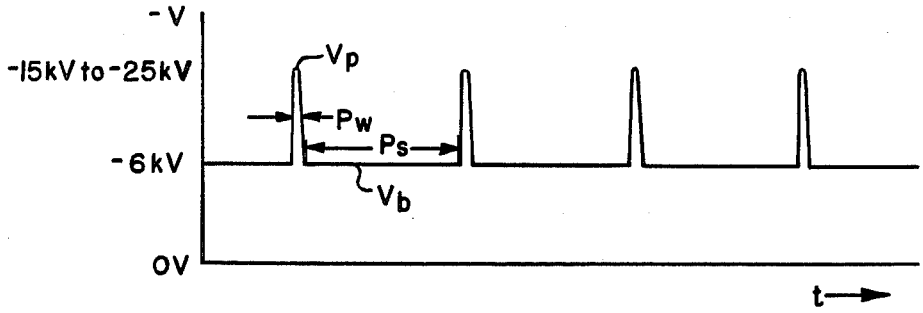
FIG. 5 is an electrical waveform diagram of the output of a pulsed power supply for the field charging stage illustrated in FIG. 1.

The field charging stage 14 is preferably a conventional field charging precipitator stage which is segmented and pulsed powered as discussed earlier. The plate spacing $P_S$ and wire-to-wire spacing $W_w$ is conventional at $4\frac{1}{2}$ inches. FIG. 5 illustrates the pulsed power supply waveform preferred for the field charging stage 14. Basically the parameter of interest will be the base voltage $V_b$ which should be set to the highest value without causing sparking. This will maximize the field charging of the particles and their collection within the field charging stage 14. The peak voltage $V_P$ of the high voltage pulses should be short enough not to cause sparkover and at a frequency such that the current is maintained just below back corona. In a conventional field charging stage 14 with a pulsed power supply, such pulses can be anywhere from 30–200 microseconds in width with an interpulse spacing of 2–20 milliseconds. The base voltage $V_b$ should be maintained just below the threshold.

Figure 7:
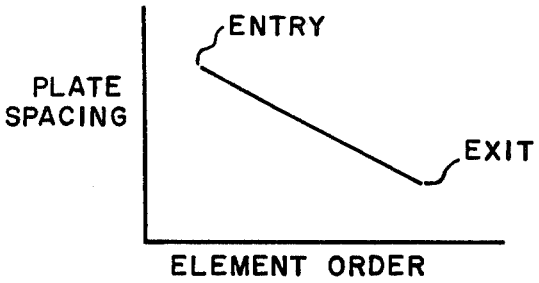
FIG. 7 is a graphical representation of plate spacing as a function of element order for a preferred embodiment of the electron charging stage illustrated in FIG. 1.

The electron charging stage 16 preferably comprises many short (small number of rows) wire-plate sections with minimal plate spacing. The volume of the sections are reduced in proportion to the spacing reduction. The minimal plate spacing enhances the electron charging capability of the precipitator and can be used because 90 percent of the dust loading, mainly the coarse particulate matter, has been removed. For example, the plate spacing would be on the order of 4 inches with a wire-to-wire spacing of approximately 3 inches. The plate spacing to element order preferably will begin with a matching area to the field charging stage 14 and then taper stepped down can be as shown in FIG. 7 to produce higher and higher electron charging enhancement and collection as the particulate matter flows through sections of the electron charging stage 16.

Figure 6:
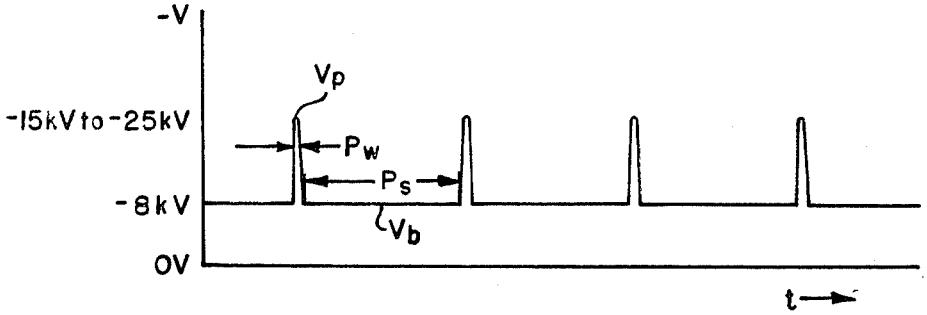
FIG. 6 is an electrical waveform diagram of the output of a pulsed power supply for the electron charging stage illustrated in FIG. 1.

The pulsed power supply will be operated as shown in the waveform of FIG. 6 to further enhance the electrical effect of the plate spacing and physical dimensions. The waveform illustrates that a base voltage $V_b$ is maintained between the plates on the order of $-8$ kV. such that a high diffusivity/mobility ratio is provided for the electrons. Further, the peak voltage $V_p$ of the pulses is controlled such that the average voltage of the waveform does not exceed the sparking limit but each pulse creates intense corona and generates a maximum number of electrons. Thus, the pulses will be of the same approximate width, the pulse spacing will be approximately the same and the peak voltage similar as that of the waveform illustrated in FIG. 4.

Figure 12:
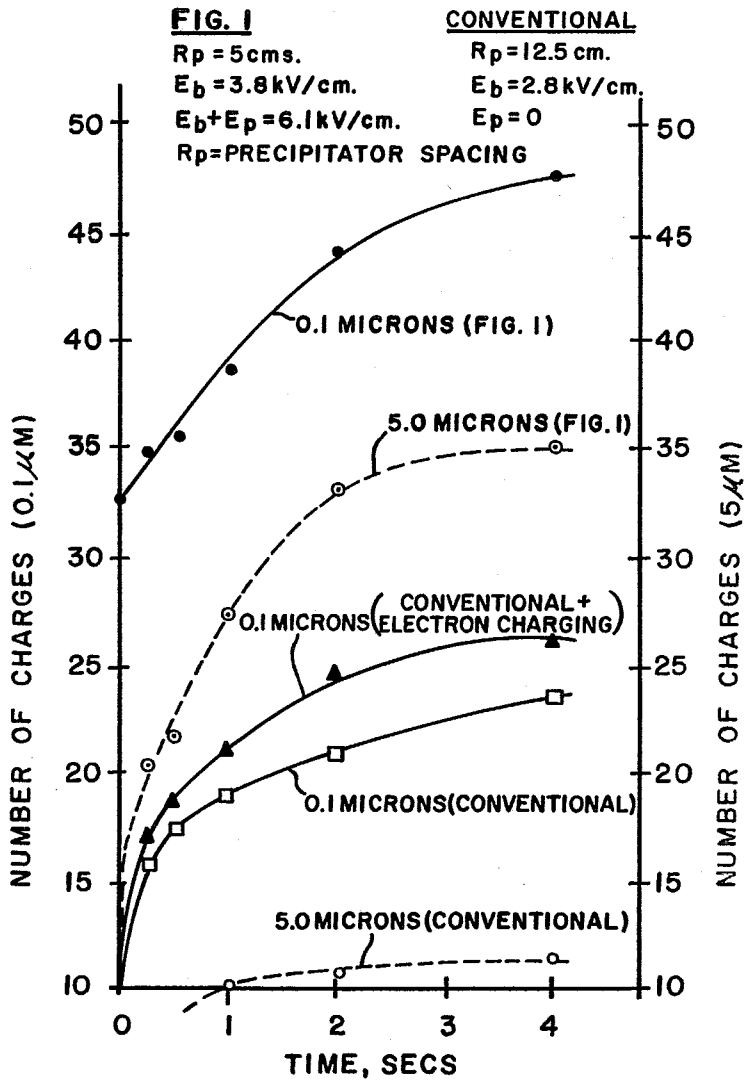
FIG. 12 is a graphical representation of the theoretical performance of the precipitator illustrated in FIG. 1 compared with that of a conventional precipitator.

FIG. 12 illustrates the theoretical operation expected from a precipitator constructed in accordance with the invention. The graphical representation compares the charge placed on a 0.1 micron particle by the precipitator shown in FIG. 1 with that charge which could be placed on the particle by a conventional precipitator. The parameters Eb and Ep correspond to the electric fields generated by the base voltage Vb and the peak pulse voltage Vp, respectively. The graphical representation also compares the charge on a 5 micron particle where both diffusion and electron charging are negligible but the high field resulting from closer plate spacing, greater sectionalization, and pulsing enhance the field charging potential. It is seen that the enhancement factor is about 2 for fine particles and 3 for the coarse particles. The size of such a system would be less than one third that of a conventional precipitator designed to do the same job.

While there has been shown dedicated stages for each type of charging mechanism, i.e., diffusion, field, and electron charging, it should be noted that for a particular stage every type of charging is occurring to some degree. Each of the stages is tailored to provide charging primarily by the corresponding mechnism. The diffusion charging stage will exhibit some electron charging before attachment, and some field charging even with a minimal DC field. The other stages will react similarly.

While a preferred embodiment of the invention has been illustrated, it will be obvious to those skilled in the art that various modifications and changes may be made thereto without departing from the spirit and scope of the invention as defined in the appended claims. While in the preferred implementation a novel combination of a diffusion charging stage 10, field charging stage 14 and electron charging stage 16 has been shown to advantage, several of the stages and combinations thereof have utility independent of the illustrated implementation.

For example, the electron charging stage 16 can be used alone. The electron charging stage 16 may act as a precipitator independently for conditions of light dust loading where fine particulate matter is entrained in the effluent. In such cases the necessity for a separate field charging stage is not present. During such conditions, of course, the diffusion charging stage 10 can be used as a precharging stage for the electron charging stage 16 to enhance its operation. Another possible combination for dust of fine and coarse sizes is to use the field charging stage 14 and electron charging stage 16 without the diffusion charging stage or any precharging. While not considered as efficient as the preferred implementation, this combination is still consideably more efficient than conventional precipitators. Finally, the diffusion charging stage 10 can be used as a precharging stage for a conventional field charging stage 14. While the plate spacing $P_S$ of the field charging stage would have to be minimized to enhance the collection of fine particulate matter. The charging of such fine matter will be handled by the diffusion charging sage 10.

What is claimed is:

1. An electrostatic precipitator having multiple stages for precipitating particulate matter from an effluent gas, comprising:

means forming a first stage for precharging fine particulate matter suspended in said effluent primarily by diffusion charging;

means forming a second stage for charging and precipitating coarse particulate matter suspended in said effluent primarily by field charging; and means forming a third stage for increasing the charge on and precipitating said fine particulate matter suspended in said effluent primarily by electron charging

2. An electrostatic precipitator as defined in claim 1, wherein said means for forming a third stage include:

a plurality of precipitator elements, each including a pair of substantially parallel collection plates used as an anode and forming a channel through which effluent passes and at least one wire acting as a cathode for generating electrons by corona discharge located between said plates to charge said fine particulate matter, said collection plates spaced apart from each other a distance allowing the optimum exposure of said fine particulate matter to said electrons; and a plurality of pulsed power supplies, each connected to at least a respective one of said precipitator elements at its cathode, for generating periodic high voltage pulses at a repetition rate and peak voltage sufficient to generate a large number of electrons at a high kinetic energy to charge said fine particulate matter and for maintaining a substantially constant collection voltage between said cathode and said collection plates in the interval between pulses.

3. An electrostatic precipitator as defined in claim 2 wherein:

the spacing between said collection plates is 4 inches.

4. An electrostatic precipitator as defined in claim 2 wherein:

the peak voltage of said high voltage pulses is between −15 and −25 kV.

5. An electrostatic precipitator as defined in claim 2 wherein:

the interval between said high voltage pulses is between 2–20 millisecs.

6. An electrostatic precipitator as defined in claim 2 therein:

said collection voltage produces a collection field between said plates which is in excess of −14 kV/cm.

7. An electrostatic precipitator as defined in claim 2 wherein:

said high voltage pulses have a pulse width of between 30–200 microseconds.

8. An electrostatic precipitator as defined in claim 2 wherein:

said fine particulate matter generally has a diameter of less than one micron.

9. An electostatic precipitator as defined in claim 1, wherein said means for forming a first stage include:

a plurality of precipitator elements, each including a pair of spaced, substantially parallel collection plates used as an anode and forming a channel through which effluent passes and at least one wire acting as a cathode for generating electrons by corona discharge located between said plates to charge the fine particulate matter, said electrons charging gas molecules of said effluent to become ions: and a plurality of pulsed of power suplies, each connected to at least a respective one of said precipitator elements at its cathode, for generating periodic high voltage pulses at a repetition rate and peak voltage sufficient to generate a large number of electrons and thereby ions to charge said fine particulate matter and at a minimal time average field to optimize ion life time.

10. An electrostatic precipitator as defined in claim 9 wherein:

the spacing between said collection plates is 4 inches.

11. An electrostatic precipitator as defined in claim 9 wherein:

the peak voltage of said high voltage pulses is between −15 and −25 kv.

12. An electrostatic precipitator as defined in claim 9 wherein:

the interval between said high voltage pulses is between 2–20 milliseconds.

13. an electrostatic precipitator as defined in claim 9 wherein:

said high voltage pulses have a pulse width of between 30–200 microseconds.

14. An electrostatic precipitator as defined in claim 1, wherein said means for forming a second stage include:

a plurality of precipitator elements, each including a pair of substantially parallel collection plates used as an anode and forming a channel through which effluent passes and at least one wire acting as a cathode for generating electrons by corona discharge located between said plates to charge said coarse particulate matter, said electrons charging gas molecules of said effluent to become ions and said collection plates spaced apart from each other a distance allowing the optimum exposure of said coarse particulate matter to said ions; and a plurality of pulsed power supplies, each connected to at least a respective one of said precipitator elements at its cathode, for generating periodic high voltage pulses at a repetition rate and peak voltage sufficient to generate a large number of electrons and thereby ions to charge said coarse particulate matter and for maintaining a substantially constant collection voltage between said cathode and said collection plates in the interval between pulses.

15. An electostatic precipitator as defined in claim 14 wherein:

said spacing between said collection plates is approximately 4.5 inches.

16. An electrostatic precipitator as defined in claim 14 wherein:

the peak voltage of said high voltage pulses is between −15 and −25 kV.

17. An electrostatic precipitator as defined in claim 14 wherein:

the interval between said high voltage pulses is between 2–20 millisecs.

18. An electrostatic precipitator as defined in claim 14 wherein:

said collection voltage is in excess of 4 kV/cm.

19. An electrostatic precipitator as defined in claim 14 wherein:

said high voltage pulses have a pulse width of between 30–200 microsecs.

20. An electrostatic precipitator having multiple stages for precipitating particulate matter from an effluent gas, comprising:

means forming a first stage for precharging fine particulate matter suspended in said effluent primarily by diffusion charging; and means forming a second stage for charging coarse particulate matter suspended in said effluent primarily by field charging and for precipitating said precharged fine particulate matter and said charged coarse particulate matter.

21. An electrostatic precipitator as defined in claim 20, wherein said means for forming a first stage include:

a plurality of precipitator elements, each including a pair of substantially parallel collection plates used as an anode and forming a channel through which effluent passes and at least one wire acting as a cathode for generating electrons by corona discharge located between said plates to charge the fine particulate matter, said electrons charging gas molecules of said effluent to become ions;

a plurality of pulsed power supplies, each connected to at least a respective one of said precipitator elements at its cathode, for generating periodic high voltage pulses at a repetition rate and peak voltage sufficient to generate a large number of electrons and thereby ions to charge said fine particulate matter and at a minimal time average field to optimize ion life time.

22. An electrostatic precipitator as defined in claim 20, wherein said means for forming a second stage include:

a plurality of precipitator elements, each including a pair of substantially parallel collection plates used as an anode and forming a channel through which effluent passes and at least one wire acting as a cathode for generating electrons by corona discharge located between said plates to charge said coarse particulate matter, said electrons charging gas molecules of said effluent to become ions and said collection plates spaced apart from each other a distance allowing the optimum exposure of said coarse particulate matter to said ions; and a plurality of pulsed power supplies, each connected to at least a respective one of said precipitator elements at its cathode, for generating periodic high voltage pulses at a repetition rate and peak voltage sufficient to generate a large number of electrons and thereby ions to charge said coarse particulate matter and for maintaining a substantially constant collection voltage between said cathode and said collection plates in the interval between pulses.

23. an electrostatic precipitator having multiple stages for precipitating particulate matter from an effluent gas, comprising:

means forming a first stage for precharging fine particulate matter suspended in said effluent primarily by diffusion charging; and means forming a second stage for increasing the charge on and precipitating said fine particulate matter suspended in said effluent primarily by electron charging.

24. An electrostatic precipitator as defined in claim wherein said means for forming a first stage include:

a plurality of precipitator elements, each including a pair of substantially parallel collection plates used as an anode and forming a channel through which effluent passes and at least one wire acting as a cathode for generating electrons by corona discharge located between said plates to charge the fine particulate matter, said electrons charging gas molecules of said effluent to become ions; and a plurality of pulsed power supplies, each connected to at least a respective one of said precipitator elements at its cathode, for generating periodic high voltage pulses at a repetition rate and peak voltage sufficient to generate a large number of electrons and thereby ions to charge said fine particulate matter and at a minimal time average field to optimize ion life time.

25. An electrostatic precipitator as defined in claim 23, wherein said means for forming a second stage include:

a plurality of precipitator elements, each including a pair of substantially parallel collection plates used as an anode and forming a channel through which effluent passes and at least one wire acting as a cathode for generating electrons by corona discharge located between said plates to charge said fine particulate matter, said collection plates spaced apart from each other a distance allowing the optimum exposure of said fine particulate matter to said electrons; and a plurality of pulsed power supplies, each connected to at least a respective one of said precipitator elements at its cathode, for generating periodic high voltage pulses at a repetition rate and peak voltage sufficient to generate a large number of electrons at a high kinetic energy to charge said fine particulate matter and for maintaining a substantially constant collection voltage between said cathode and said collection plates in the interval between pulses.

* * * * *

UNITED STATES PATENT AND TRADEMARK OFFICE

CERTIFICATE OF CORRECTION

PATENT NO. : 4,778,493

DATED : October 18, 1988

INVENTOR(S) : Fitch, et al.

It is certified that error appears in the above-identified patent and that said Letters Patent is hereby corrected as shown below:

Column 1, lines 35-36, change "mechanism" to --mechanisms--;

line 45, change "micron" to --microns--.

Column 4, line 61, change "energ" to --energy--;

line 62, change "in" to --ion--.

Column 5, line 61, after "diffusivity" insert a comma;

line 66, change "$X_3$0.04" to --$X_3$=0.04--.

Column 7, line 39, change "pecipitator" to --precipitator--;

line 39, change "write" to --wire--;

line 62, change "elecron" to --electron--.

Column 8, line 6, change "kinertic" to --kinetic--;

line 6, change "charing" to --charging--;

line 10, change "cna" to --can--;

line 10, change "resonable" to --reasonable--;

line 12, change "ara" to --area--;

line 24, change "voer" to --over--;

line 31, change "byits" to --by its--;

line 31, change "functions" to --function--;

line 42, change "$V_{rd}$" to --$v_{rd}$--.

UNITED STATES PATENT AND TRADEMARK OFFICE

CERTIFICATE OF CORRECTION

PATENT NO. : 4,778,493

DATED : October 18, 1988

INVENTOR(S) : Fitch, et al.

It is certified that error appears in the above-identified patent and that said Letters Patent is hereby corrected as shown below:

Column 9, line 14, change "$F_w(r)$" to --$f_w(r)$--;
line 23, in equation (21), change "N" to --n--;
line 58, change "M" to --m--.

Column 11, line 10, change "preheate" to --preheater--;
line 12, change "diffus" to --diffusion--;
line 13, after "on" insert --a--;
line 14, change "charging 10 stage" to --charging stage 10--.

Column 12, line 55, after "with" delete "and";
line 68, change "4" to --4 1/2--.

Column 13, line 21, before "threshold" insert --sparking--;
line 51, insert a comma after "same";
line 51, change "similar" to --will be about the same--.

Column 14, line 8, change "mechnism" to --mechanism--;
line 37, change "consideably" to --considerably--;
line 44, change "sage" to --stage--;
line 58, after "charging" insert a period.

UNITED STATES PATENT AND TRADEMARK OFFICE

CERTIFICATE OF CORRECTION

PATENT NO. : 4,778,493

DATED : October 18, 1988

INVENTOR(S) : Fitch, et al.

It is certified that error appears in the above-identified patent and that said Letters Patent is hereby corrected as shown below:

In the Claims:

Column 15, line 25, change "therein" to --wherein--;
line 27, change "-14" to --4--;
line 47, change ":" to --;--;
line 48, change "suplies" to --supplies--;
line 62, change "kv" to --kV--;
line 67, change "an" to --An--.
Column 17, line 32, change "an" to --An--.
Column 18, line 1, after "claim" insert --23,--.

Signed and Sealed this

Eleventh Day of April, 1989

*Attest:*

*Attesting Officer*

DONALD J. QUIGG

*Commissioner of Patents and Trademarks*